US009124048B2

(12) United States Patent
Golko et al.

(10) Patent No.: US 9,124,048 B2
(45) Date of Patent: Sep. 1, 2015

(54) FLEXIBLE TRS CONNECTOR

(75) Inventors: Albert J. Golko, Saratoga, CA (US); Mathias W. Schmidt, San Francisco, CA (US); Eric S. Jol, San Jose, CA (US); Ian Spaggs, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 241 days.

(21) Appl. No.: 13/703,000

(22) PCT Filed: Jun. 9, 2011

(86) PCT No.: PCT/US2011/039870

§ 371 (c)(1),
(2), (4) Date: Feb. 28, 2013

(87) PCT Pub. No.: WO2011/156653

PCT Pub. Date: Dec. 15, 2011

(65) Prior Publication Data

US 2013/0210286 A1 Aug. 15, 2013

Related U.S. Application Data

(60) Provisional application No. 61/353,126, filed on Jun. 9, 2010, provisional application No. 61/407,363, filed on Oct. 27, 2010.

(51) Int. Cl.
*H01R 29/00* (2006.01)
*H01R 24/58* (2011.01)
(Continued)

(52) U.S. Cl.
CPC ..... *H01R 24/58* (2013.01); *H01R 13/052* (2013.01); *H01R 13/405* (2013.01); *H01R 43/20* (2013.01);
(Continued)

(58) Field of Classification Search
CPC ..... H01R 24/58
USPC ..... 439/668, 188, 669, 944
See application file for complete search history.

(56) References Cited

U.S. PATENT DOCUMENTS 2,792,557 A 5/1957 Dowick
2,892,990 A 6/1959 Werndl
(Continued)

FOREIGN PATENT DOCUMENTS

DE 196 09 571 A1 11/1995
DE 20 2004 021354 U1 9/2007
(Continued)

OTHER PUBLICATIONS

Non-Final Office Action for U.S. Appl. No. 13/700,664, mailed Apr. 24, 2014, 14 pages.
(Continued)

*Primary Examiner* — Phuongchi T Nguyen
(74) *Attorney, Agent, or Firm* — Kilpatrick Townsend & Stockton LLP

(57) ABSTRACT

The present invention relates generally to connectors such as audio connectors and in particular to flexible audio connectors that can be used in place of standard audio connectors currently used. A portion or all of the plug connector may comprise a flexible material that allows the connector to bend with respect to an insertion axis and prevent the connector from breaking when inserted or extracted improperly. A method of assembly is provided and may be used for assembling embodiments of the plug connector. The connector is configured to mate with a corresponding receptacle connector along an insertion axis.

21 Claims, 7 Drawing Sheets

(51) Int. Cl.

| | |
|---|---|
| ***H01R 13/05*** | (2006.01) |
| ***H01R 13/405*** | (2006.01) |
| ***H01R 43/24*** | (2006.01) |
| ***H01R 43/20*** | (2006.01) |
| *H01R 13/56* | (2006.01) |
| *H01R 107/00* | (2006.01) |

(52) U.S. Cl.
CPC ..... *H01R 43/24* (2013.01); *H01R 13/562* (2013.01); *H01R 2107/00* (2013.01); *Y10T 29/49176* (2015.01)

(56) References Cited

U.S. PATENT DOCUMENTS

| | | | | |
|---|---|---|---|---|
| 3,793,614 | A | 2/1974 | Tachick et al. | |
| 3,795,037 | A | 3/1974 | Luttmer | |
| 4,361,375 | A | 11/1982 | Bailey et al. | |
| 4,621,882 | A | 11/1986 | Krumme | |
| 4,711,506 | A | 12/1987 | Tanaka | |
| 5,256,074 | A | 10/1993 | Tan | |
| 5,387,110 | A | 2/1995 | Kantner et al. | |
| 5,442,243 | A | 8/1995 | Bailey | |
| 5,967,833 | A | 10/1999 | Cachina | |
| 6,074,225 | A | 6/2000 | Wu et al. | |
| 6,179,627 | B1 | 1/2001 | Daly et al. | |
| 6,309,255 | B1 | 10/2001 | Yu | |
| 6,364,699 | B1 | 4/2002 | Hwang et al. | |
| 6,410,857 | B1 | 6/2002 | Gonya | |
| 6,533,617 | B1 | 3/2003 | D'Addario | |
| 6,869,320 | B2 | 3/2005 | Haas et al. | |
| 6,981,887 | B1 | 1/2006 | Mese et al. | |
| 7,094,089 | B2 | 8/2006 | Andre et al. | |
| 7,115,124 | B1 * | 10/2006 | Xiao | 606/41 |
| 7,198,522 | B1 | 4/2007 | Ho et al. | |
| 7,361,059 | B2 | 4/2008 | Harbarki et al. | |
| 7,407,416 | B1 | 8/2008 | Rogers et al. | |
| 7,435,107 | B2 | 10/2008 | Matsumoto et al. | |
| 7,442,091 | B2 | 10/2008 | Salomon et al. | |
| 7,458,825 | B2 | 12/2008 | Atsmon et al. | |
| 7,500,861 | B2 | 3/2009 | Harbarki et al. | |
| 7,716,400 | B2 | 5/2010 | Raines | |
| 7,717,717 | B1 | 5/2010 | Lai | |
| 7,854,633 | B2 | 12/2010 | Lynch et al. | |
| 7,918,685 | B1 | 4/2011 | Kruckenberg | |
| 8,317,527 | B2 | 11/2012 | Vitale | |
| 8,698,699 | B2 | 4/2014 | Saarela et al. | |
| 2002/0025729 | A1 | 2/2002 | D'Addario | |
| 2003/0016509 | A1 | 1/2003 | Tsukamoto | |
| 2004/0215966 | A1 | 10/2004 | Elteto | |
| 2004/0229515 | A1 | 11/2004 | Kaneda et al. | |
| 2005/0085136 | A1 | 4/2005 | Zhang | |
| 2005/0202727 | A1 | 9/2005 | Andre et al. | |
| 2006/0024997 | A1 | 2/2006 | Teicher | |
| 2006/0289201 | A1 | 12/2006 | Kim et al. | |
| 2007/0037452 | A1 | 2/2007 | Martin et al. | |
| 2007/0072442 | A1 | 3/2007 | DiFonzo | |
| 2007/0082701 | A1 | 4/2007 | Seil et al. | |
| 2007/0178771 | A1 | 8/2007 | Goetz et al. | |
| 2007/0243726 | A1 | 10/2007 | Trenne | |
| 2008/0032562 | A1 | 2/2008 | McHugh et al. | |
| 2008/0090465 | A1 | 4/2008 | Matsumoto et al. | |
| 2008/0119076 | A1 | 5/2008 | Teicher | |
| 2008/0167828 | A1 | 7/2008 | Terlizzi et al. | |
| 2008/0188137 | A1 | 8/2008 | Goetz et al. | |
| 2008/0274633 | A1 | 11/2008 | Teicher | |
| 2009/0004923 | A1 | 1/2009 | Tang et al. | |
| 2009/0081906 | A1 * | 3/2009 | Lynch et al. | 439/668 |
| 2009/0108848 | A1 | 4/2009 | Lundquist | |
| 2009/0117768 | A1 | 5/2009 | Liao | |
| 2009/0156027 | A1 | 6/2009 | Chen | |
| 2009/0180243 | A1 | 7/2009 | Lynch et al. | |
| 2009/0185707 | A1 | 7/2009 | Smith | |
| 2009/0196553 | A1 * | 8/2009 | Anderson et al. | 385/54 |
| 2010/0009575 | A1 | 1/2010 | Crooijmans et al. | |
| 2010/0062656 | A1 * | 3/2010 | Lynch et al. | 439/669 |
| 2010/0087099 | A1 | 4/2010 | Fadell et al. | |
| 2010/0104126 | A1 | 4/2010 | Greene | |
| 2010/0190382 | A1 | 7/2010 | Szini | |
| 2010/0201602 | A1 | 8/2010 | Saarela et al. | |
| 2010/0208631 | A1 | 8/2010 | Zhang et al. | |
| 2011/0059649 | A1 | 3/2011 | Montena | |
| 2011/0250786 | A1 | 10/2011 | Reid | |
| 2011/0269352 | A1 | 11/2011 | Vitale | |
| 2012/0220148 | A1 | 8/2012 | Walls, Jr. | |
| 2013/0078869 | A1 | 3/2013 | Golko et al. | |

FOREIGN PATENT DOCUMENTS

| | | | |
|---|---|---|---|
| DE | 202007009637 | U1 | 11/2007 |
| EP | 0081372 | A2 | 6/1983 |
| EP | 1898499 | A2 | 3/2008 |
| FR | 2138961 | A1 | 1/1973 |
| JP | 2 078171 | A | 3/1990 |
| JP | 2003-217728 | A | 7/2003 |
| JP | 2004 079491 | A | 3/2004 |
| WO | 2004/097995 | A1 | 11/2004 |
| WO | 2005/013436 | A1 | 2/2005 |
| WO | 2006/013553 | A2 | 2/2006 |
| WO | 2006/074348 | A1 | 12/2006 |
| WO | 2008/065659 | A2 | 6/2008 |
| WO | 2008076925 | A2 | 6/2008 |
| WO | 2009/069969 | A2 | 6/2009 |
| WO | 2009/140992 | A1 | 11/2009 |

OTHER PUBLICATIONS

Office Action for Korean Application No. 10-2012-7034041, mailed Jun. 13, 2014, 14 pages.

International Preliminary Report on Patentability for International PCT Application No. PCT/US2011/038451, mailed Dec. 4, 2012, 7 pages.

Written Opinion for PCT Application No. PCT/US2011/039870, mailed Oct. 4, 2011, 6 pages.

Flipper Press Release (Jun. 25, 2012) and Data Sheet: http://www.flipperusb.com/images/flipperUSB-brochure.pdf, http://www.flipperusb.com/images/flipperUSB-brochure.pdf.

International Search Report for International PCT Application No. PCT/US2011/038452, mailed on Oct. 26, 2011, 7 pages.

International Search Report and Written Opinion for International PCT Application No. PCT/US2011/041286, mailed on Oct. 20, 2011, 18 pages.

International Search Report and Written Opinion for International PCT Application No. PCT/US2011/041127, mailed on Dec. 29, 2011, 17 pages.

International Search Report and Written Opinion for International PCT Application No. PCT/US2011/041290, mailed on Nov. 21, 2011, 21 pages.

PCT Publication No. WO 2011/156653 A1, Pub. Date Dec. 15, 2011 for Application No. PCT/US2011/039870 and International Search Report; Oct. 4, 2011, 27 pages.

International Preliminary Report on Patentability for PCT/US2011/039870; Mailed Dec. 20, 2012, 8 pages.

International Search Report and Written Opinion; PCT/US2011/038451; mailed Sep. 15, 2011, 13 pages.

Office Action for Chinese Application No. 201180028048.8, mailed Sep. 28, 2014, 18 pages.

Non-Final Office Action for U.S. Appl. No. 13/700,664, mailed Mar. 4, 2015, 5 pages.

Final Office Action for U.S. Appl. No. 13/700,664, mailed Nov. 3, 2014, 6 pages.

Extended European Search Report, EP App. No. 11793200.4, mailed Nov. 11, 2014, 9 pages.

Extended European Search Report, EP App. No. 11787546.8, mailed Nov. 17, 2014, 9 pages.

* cited by examiner

FLEXIBLE TRS CONNECTOR

CROSS-REFERENCES TO RELATED APPLICATIONS

This is a National Stage entry of PCT/US11/39870 filed Jun. 9, 2011, which claims the benefit of U.S. Provisional Patent Applications No. 61/353,126, filed Jun. 9, 2010 and 61/407,363, filed Oct. 27,2010, each of which are incorporated by reference herein in their entirety.

BACKGROUND OF THE INVENTION

The present invention relates generally to connectors such as audio connectors and in particular to flexible audio connectors that can be used in place of standard audio connectors currently used.

Standard audio connectors or plugs are available in three sizes according to the outside diameter of the plug: a 6.35 mm (¼") plug, a 3.5 mm (⅛") miniature plug and a 2.5 mm (3/32") subminiature plug. The plugs include multiple conductive regions that extend along the length of the connectors in distinct portions of the plug such as the tip, sleeve and one or more middle portions between the tip and sleeve resulting in the connectors often being referred to as TRS (tip, ring and sleeve) connectors.

FIGS. 1A and 1B illustrate examples of audio plugs 10 and 20 having three and four conductive portions, respectfully. As shown in FIG. 1A, plug 10 includes a conductive tip 12, a conductive sleeve 14 and a conductive ring 16 electrically isolated from the tip 12 and the sleeve 14 by insulating rings 17 and 18. The three conductive portions 12, 14, and 16 are for left and right audio channels and a ground connection. Plug 20, shown in FIG. 1B, includes four conductive portions: a conductive tip 22, a conductive sleeve 24 and two conductive rings 25 and 26 and is thus sometimes referred to as a TRRS (tip, ring, ring, sleeve) connector. The four conductive portions are electrically isolated by insulating rings 27, 28 and 29 and are typically used for left and right audio, microphone and ground signals.

When plugs 10 and 20 are 3.5 mm miniature connectors, the outer diameter of conductive sleeve 14 and 24 and conductive rings 16, 25, and 26 is 3.5 mm and the connector is 14 mm long, and for a 2.5 mm subminiature connector the outer diameter of the conductive sleeve is 2.5 mm and the connector is 11 mm long. Such TRS and TRRS connectors are used in many commercially available MP3 players and smart phones as well as other electronic devices. However, these connectors are prone to breaking when inserted or extracted with a force that intersects its insertion axis.

Electronic devices such as MP3 players and smart phones are continuously being designed to be thinner and smaller and/or to include video displays with screens that are pushed out as close to the outer edge of the devices as possible. The diameter and length of current 3.5 mm and even 2.5 mm audio connectors are limiting factors in making such devices smaller, thinner and allowing the displays to be larger. This reduction in size of connectors can further exacerbate their tendency to break when inserted or extracted with a force that intersects its insertion axis.

Some manufacturers have used USB, mini-USB and micro-USB connectors as audio connectors to connect headphones and similar audio components to electronic devices. FIG. 2 is an example of a micro-USB connector 30, the smallest of the USB connectors. Connector 30 includes an outer housing 32 and a metallic shell 34 that is inserted into a corresponding receptacle connector. Shell 34 defines an interior cavity 38 and includes five contacts 36 formed within the cavity. The insertable shell portion 34 of connector 30 is both thinner and shorter than even the 2.5 mm subminiature version of connectors 10 and 20. Connector 30, however, suffers from other drawbacks that detract from the overall user experience. For example, connector 30 must be inserted into its respective receptacle connector in a particular orientation, yet it is difficult for the user to determine when connector 30 is oriented in the correct insertion position. Also, even when connector 30 is properly aligned, the insertion and extraction of the connector is not precise, has an inconsistent feel and, even when the connector is fully inserted, has an undesirable degree of wobble that may result in either a faulty connection or breakage. These connectors are also prone to breaking when inserted or extracted with a force that intersects its insertion axis.

BRIEF SUMMARY OF THE INVENTION

In view of the shortcomings in currently available audio connectors as described above, the present invention provides an improved audio plug connector comprising flexible materials that allow the connector to bend with respect to an insertion axis along which the plug connector is designed to be inserted into a corresponding receptacle connector and prevent the connector from breaking when inserted or extracted improperly.

In one embodiment, a plug connector according to the present invention comprises a body and a sleeve that extends out of and longitudinally away from the body. The sleeve has a circular cross section with an end contact at its distal tip and a plurality of ring contacts between the end contact and the body with each of the ring contacts being separated by a dielectric material. The connector is configured to mate with a corresponding receptacle connector along an insertion axis. Portions of the body and/or sleeve are made from a flexible material that allows the plug connector to bend with respect to the insertion axis. Bending in this manner relieves strain if the plug connector is inserted into or extracted from the corresponding receptacle connector under a force applied to the plug connector in a direction that intersects the insertion axis, i.e., an off angle mating event. Then, when the strain causing force is removed, the connector returns to its original shape without requiring a change of temperature.

In some embodiments, the connector is made flexible by incorporating a flexible elastomer, such as a thermoplastic elastomer, into the body of the connector. In other embodiments the connector includes a flexible inner member that traverse a length of the sleeve. In some embodiments the flexible inner member can be a superelastic material, such as nitinol, coated with a conductive layer that is electrically connected to the end contact. In some additional embodiments both the body and the sleeve are made from flexible materials.

A method of assembling embodiments of the present invention, may include the following steps: stripping a cable and soldering its wires to connect with sleeve contacts, innnermolding with a flexible dielectric to capture components on the proximal end of the sleeve, overmolding a portion of the innermold and the cable with a flexible dielectric for strain relief, and gluing on a shell.

To better understand the nature and advantages of the present invention, reference should be made to the following description and the accompanying figures. It is to be understood, however, that each of the figures is provided for the purpose of illustration only and is not intended as a definition of the limits of the scope of the present invention.

BRIEF DESCRIPTION OF THE DRAWINGS

FIG. 2A shows a perspective view of a previously known micro-USB plug connector while

DETAILED DESCRIPTION OF THE INVENTION

Embodiments of the present invention pertain to connectors such as audio jacks and in particular to a flexible audio connector that can be used in place of the standard rigid connectors and electronic devices using standard rigid connectors. These connectors may be suitable for a multiplicity of electronic devices, including any device with audio out signals (e.g., radio, landline phone, stereo). In some embodiments, the invention is particularly well suited for portable electronic media devices.

As used herein, an electronic media device includes any device with at least one electronic component that may be used to present human-perceivable media. Such devices may include, for example, portable music players (e.g., Apple's iPod devices), portable video players (e.g., portable DVD players), cellular telephones (e.g., Apple's iPhone devices), video cameras, digital still cameras, projection systems (e.g., holographic projection systems), gaming systems, PDAs, desktop computers, as well as tablet or other mobile computers (e.g., Apple's iPad devices). Some of these devices may be configured to provide audio, video or other sensory output.

Figure 3:
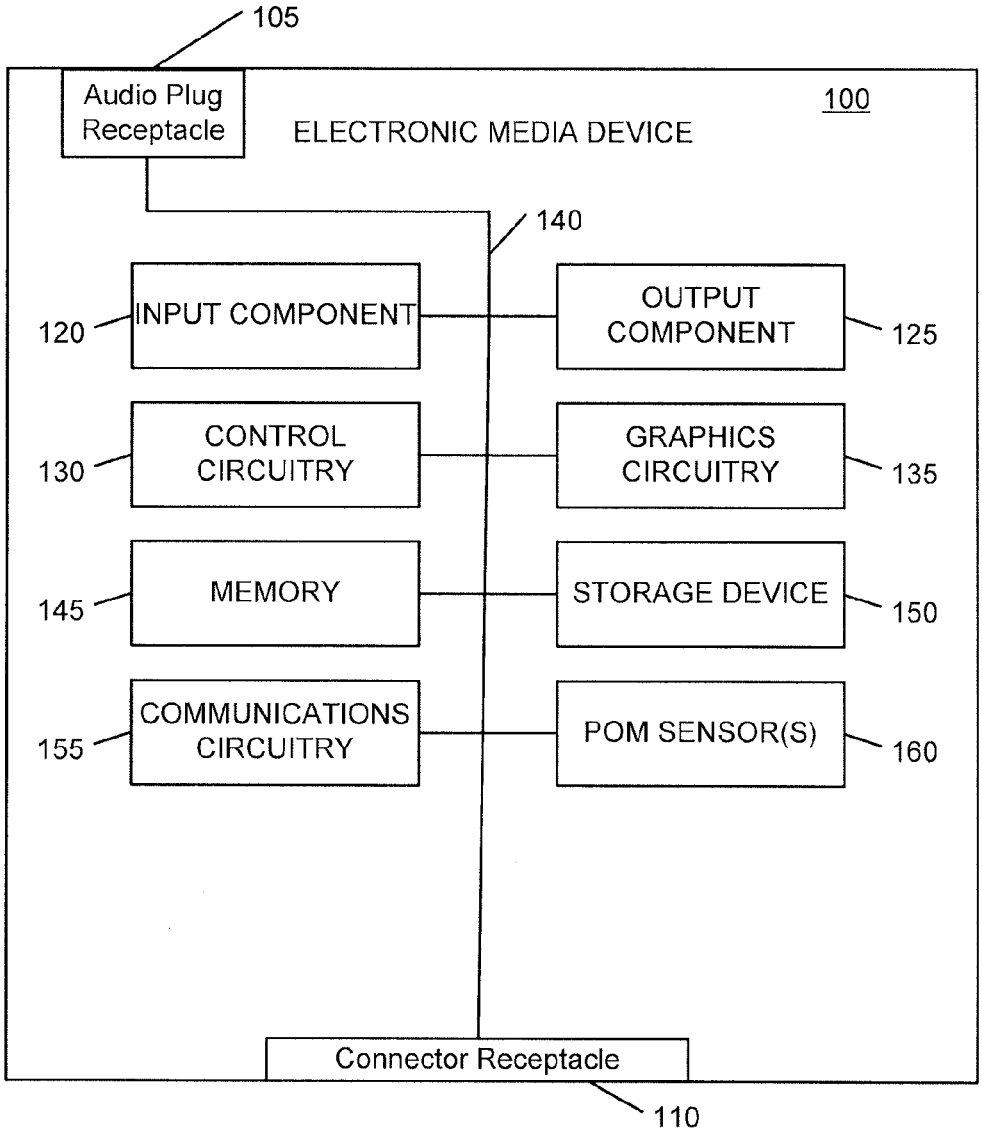
FIG. 3 is a simplified illustrative block diagram of an electronic media device suitable for use with embodiments of the present invention.

FIG. 3 is a simplified illustrative block diagram representing an electronic media device 100 that includes an audio plug receptacle 105 according to embodiments of the present. Electronic media device 100 may also include, among other components, connector receptacle 110, one or more user input components 120, one or more output components 125, control circuitry 130, graphics circuitry 135, a bus 140, a memory 145, a storage device 150, communications circuitry 155 and POM (position, orientation or movement sensor) sensors 160. Control circuitry 130 may communicate with the other components of electronic media device 100 (e.g., via bus 140) to control the operation of electronic media device 100. In some embodiments, control circuitry 130 may execute instructions stored in a memory 145. Control circuitry 130 may also be operative to control the performance of electronic media device 100. Control circuitry 130 may include, for example, a processor, a microcontroller and a bus (e.g., for sending instructions to the other components of electronic media device 100). In some embodiments, control circuitry 130 may also drive the display and process inputs received from input component 120.

Memory 145 may include one or more different types of memory that may be used to perform device functions. For example, memory 145 may include cache, flash memory, ROM, RAM and hybrid types of memory. Memory 145 may also store firmware for the device and its applications (e.g., operating system, user interface functions and processor functions). Storage device 150 may include one or more suitable storage mediums or mechanisms, such as a magnetic hard drive, flash drive, tape drive, optical drive, permanent memory (such as ROM), semi-permanent memory (such as RAM) or cache. Storage device 150 may be used for storing media (e.g., audio and video files), text, pictures, graphics, advertising or any suitable user-specific or global information that may be used by electronic media device 100. Storage device 150 may also store programs or applications that may run on control circuitry 130, may maintain files formatted to be read and edited by one or more of the applications and may store any additional files that may aid the operation of one or more applications (e.g., files with metadata). It should be understood that any of the information stored on storage device 150 may instead be stored in memory 145.

Electronic media device 100 may also include input component 120 and output component 125 for providing a user with the ability to interact with electronic media device 100. For example, input component 120 and output component 125 may provide an interface for a user to interact with an application running on control circuitry 130. Input component 120 may take a variety of forms, such as a keyboard/keypad, trackpad, mouse, click wheel, button, stylus or touch screen. Input component 120 may also include one or more devices for user authentication (e.g., smart card reader, fingerprint reader or iris scanner) as well as an audio input device (e.g., a microphone) or a video input device (e.g., a camera or a web cam) for recording video or still frames. Output component 125 may include any suitable display, such as a liquid crystal display (LCD) or a touch screen display, a projection device, a speaker or any other suitable system for presenting information or media to a user. Output component 125 may be controlled by graphics circuitry 135. Graphics circuitry 135 may include a video card, such as a video card with 2D, 3D or vector graphics capabilities. In some embodiments, output component 125 may also include an audio component that is remotely coupled to electronic media device 100. For example, output component 125 may include a headset, headphones or ear buds that may be coupled to electronic media device 100 with a wire or wirelessly (e.g., Bluetooth headphones or a Bluetooth headset).

Electronic media device 100 may have one or more applications (e.g., software applications) stored on storage device 150 or in memory 145. Control circuitry 130 may be configured to execute instructions of the applications from memory 145. For example, control circuitry 130 may be configured to execute a media player application that causes full-motion video or audio to be presented or displayed on output component 125. Other applications resident on electronic media device 100 may include, for example, a telephony application, a GPS navigator application, a web browser application and a calendar or organizer application. Electronic media device 100 may also execute any suitable operating system, such as a Mac OS, Apple iOS, Linux or Windows and can include a set of applications stored on storage device 150 or memory 145 that is compatible with the particular operating system.

In some embodiments, electronic media device 100 may also include communications circuitry 155 to connect to one or more communications networks. Communications circuitry 155 may be any suitable communications circuitry operative to connect to a communications network and to transmit communications (e.g., voice or data) from electronic media device 100 to other devices within the communications network. Communications circuitry 155 may be operative to interface with the communications network using any suitable communications protocol such as, for example, Wi-Fi (e.g., a 802.11 protocol), Bluetooth, high frequency systems (e.g., 900 MHz, 2.4 GHz and 5.6 GHz communication systems), infrared, GSM, GSM plus EDGE, CDMA, quadband and other cellular protocols, VOIP or any other suitable protocol.

In some embodiments, communications circuitry 155 may be operative to create a communications network using any suitable communications protocol. Communications circuitry 155 may create a short-range communications network using a short-range communications protocol to connect to other devices. For example, communications circuitry 155 may be operative to create a local communications network using the Bluetooth protocol to couple with a Bluetooth headset (or any other Bluetooth device). Communications circuitry 155 may also include a wired or wireless network interface card (NIC) configured to connect to the Internet or any other public or private network. For example, electronic media device 100 may be configured to connect to the Internet via a wireless network, such as a packet radio network, an RF network, a cellular network or any other suitable type of network. Communication circuitry 145 may be used to initiate and conduct communications with other communications devices or media devices within a communications network.

Electronic media device 100 may also include any other component suitable for performing a communications operation. For example, electronic media device 100 may include a power supply, an antenna, ports or interfaces for coupling to a host device, a secondary input mechanism (e.g., an ON/OFF switch) or any other suitable component.

Electronic media device 100 may also include POM sensors 160. POM sensors 160 may be used to determine the approximate geographical or physical location of electronic media device 100. As described in more detail below, the location of electronic media device 100 may be derived from any suitable trilateration or triangulation technique, in which case POM sensors 160 may include an RF triangulation detector or sensor or any other location circuitry configured to determine the location of electronic media device 100.

POM sensors 160 may also include one or more sensors or circuitry for detecting the position orientation or movement of electronic media device 100. Such sensors and circuitry may include, for example, single-axis or multi-axis accelerometers, angular rate or inertial sensors (e.g., optical gyroscopes, vibrating gyroscopes, gas rate gyroscopes or ring gyroscopes), magnetometers (e.g., scalar or vector magnetometers), ambient light sensors, proximity sensors, motion sensor (e.g., a passive infrared (PIR) sensor, active ultrasonic sensor or active microwave sensor) and linear velocity sensors. For example, control circuitry 130 may be configured to read data from one or more of POM sensors 160 in order to determine the location orientation or velocity of electronic media device 100. One or more of POM sensors 160 may be positioned near output component 125 (e.g., above, below or on either side of the display screen of electronic media device 100).

Figure 4:
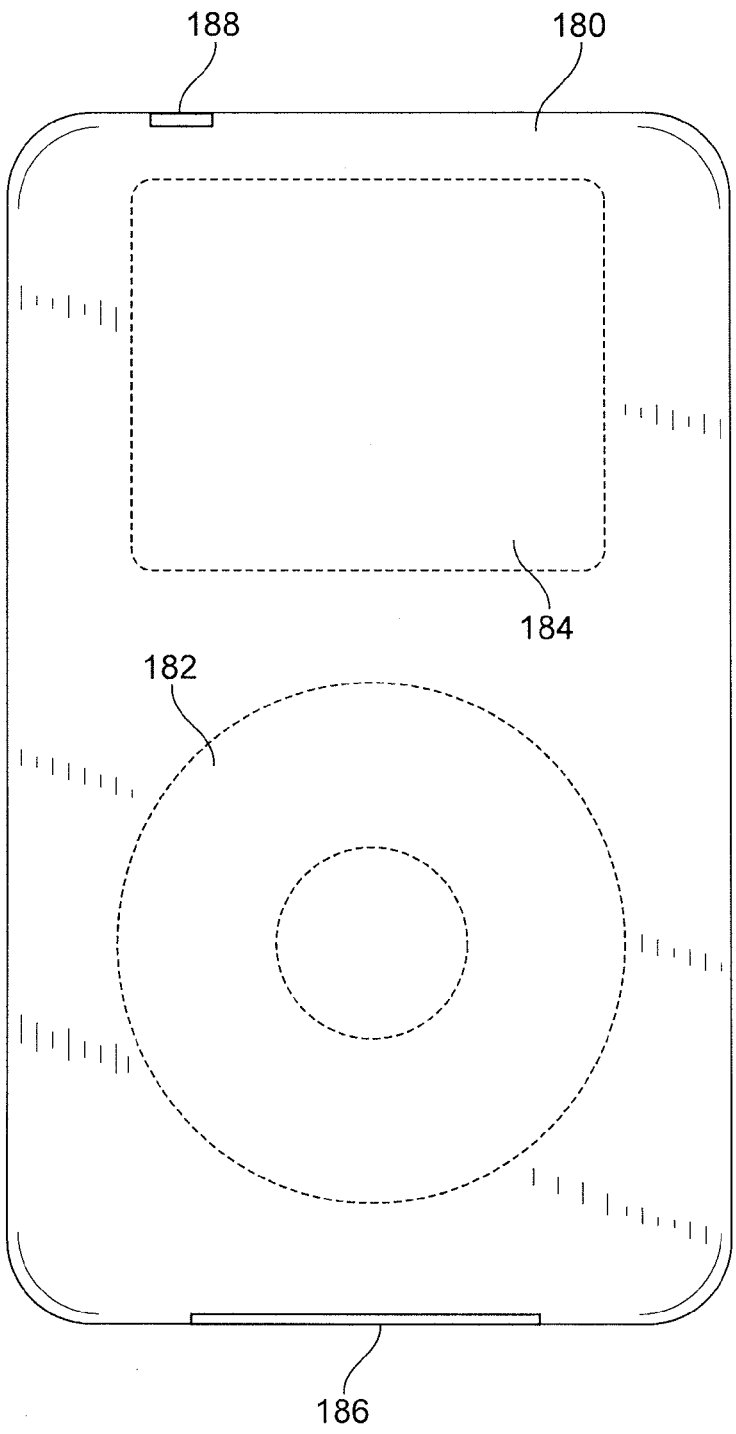
FIG. 4 depicts an illustrative rendering of one particular embodiment of an electronic media device suitable for use with embodiments of the present invention.

FIG. 4 depicts an illustrative rendering of one particular electronic media device 180. Device 180 includes a click wheel 182 as an input component and an LED display 184 as an output component. Device 180 also includes connector receptacle 186 and audio receptacle connector 188. For simplicity, various internal components, such as the control circuitry, graphics circuitry, bus, memory, storage device and other components are not shown in FIG. 4. Embodiments of the invention are particularly suitable for mating with receptacle connector 188.

Figure 5A:
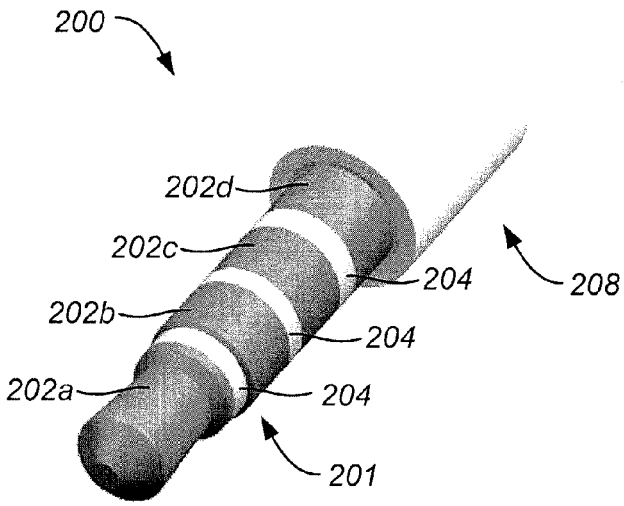
FIGS. 5A and 5B are simplified perspective and cross-sectional views and of a flexible connector according to an embodiment of the present invention.
Figure 5B:
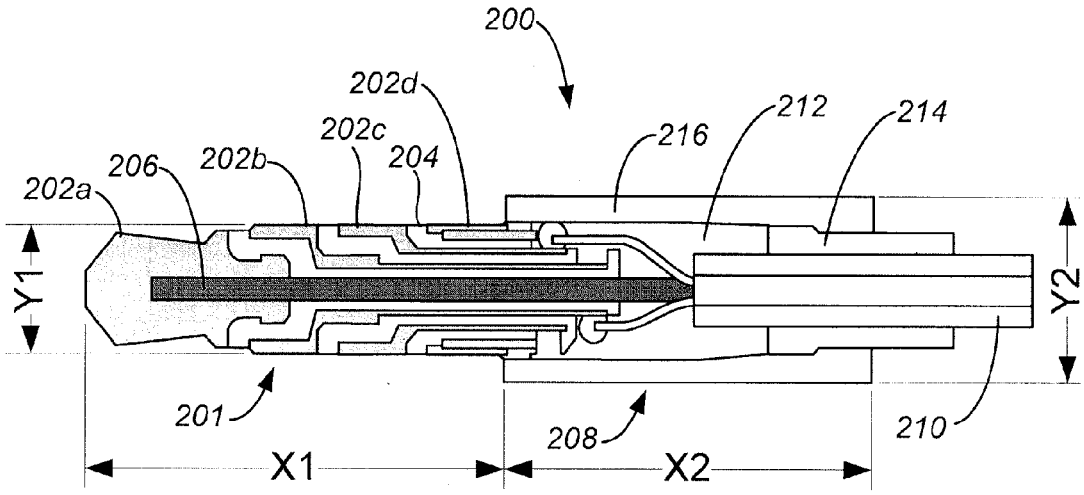

To better understand and appreciate the present invention, reference is now made to FIGS. 5A and 5B, which are simplified perspective and cross-sectional views of a flexible connector 200 according to one embodiment of the invention. Connector 200 includes a sleeve 201 that extends out of and longitudinally away from a body 208. As discussed in detail below, either one or both of sleeve 201 and body 208 can include a flexible, deformable material that allows the connector to bend along a length of the connector under strain and return to its original shape when the strain is removed.

Sleeve 201 has a circular cross section with four electrically isolated conductive portions: a contact 202*a* at its distal tip, and three sleeve ring contacts 202*b*, 202*c* and 202*d*. Each of the conductive portions is electrically isolated from each other and from contact 202*a* by insulation 204, which for example, can be a dielectric material formed around the contacts using an injection molding process. An inner conductive member 206, e.g., a conductive rod, traverses the center of the connector to carry the signal from contact 202*a*.

A cable 210 is attached to the connector end opposite the distal tip. Within cable 210 are signal wires that are soldered to contacts 202*b*-202*d* with solder connections. These signal wires are electrically connected to and carry signals from contacts 202*b*-202*d*. Inner conductive member 206 may be electrically connected to contact 202*a* on one end and to a signal wire on the other end to complete the ground connection for connector 200. The signals wires extend through cord 210, which may be coupled at its other end to an electronic device, such as a stereo headset. Thus, cable 210 connects with all of the contacts of connector 200 and runs to a location external to connector 200.

Contacts 202*a*-202*d* can be made from a copper, nickel, brass, a metal alloy or any other appropriate conductive material. In other embodiments, contacts 202*a*-202*d* can be stamped from sheet metal, formed in a sintering process from a metal powder or made according to other known techniques. In one particular embodiment, contacts 202*b*-202*d* can be brass or other metal contacts surrounded by a flexible elastomer (insulation 204) so that each axial section serves as a bending plate allowing connector 200 to bend in order to relieve stress when the connector is inserted or extracted off-axis. In another embodiment, contacts 202*b*-202*d* and insulation 204 may all be part of a flex circuit that is slid over inner conductive member 206. This arrangement allows connector 200 to flex relatively evenly along much of its length. In some embodiments, contact 202*a* is a ground contact, contact 202*b* is a left audio contact, contact 202*c* is a right audio contact, and contact 202*d* is a microphone contact. In other embodiments, the order of the contacts may be different or the contacts may be dedicated for other signals, such as video signals, data signals or the like.

As discussed above, in embodiments of the invention either or both of sleeve 201 and body 208 can include a flexible, deformable material that bends under strain and returns to its original shape when the strain is removed without requiring a change of temperature. In some embodiments, body 208 of connector 200 can include a flexible dielectric material that enables body 208 to flex along its length in order to relieve strain during off angle mating events and return to its original shape after the straining force is removed. As one example, body 208 may include flexible dielectric innermold 212 (e.g., injection molded polypropylene), a flexible dielectric overmold 214 (e.g., injection molded thermoplastic elastomer), and a jacket or shell 216 made of ABS. Shell 216 can also be made from any flexible dielectric material such as an elastomer or a polypropylene material which enables the connector to flex along the length of base 208 in order to relieve strain during off angle mating events. In one specific example, shell 216 is made from Arnitel EL250 available from DSM Engineering. All the components of body 208 may also be made of similar deformable and flexible material to provide the desired strain relief.

In some embodiments, sleeve 201 may include flexible portions or flexible materials that allow the sleeve to bend off-axis when under strain and return to its original shape when the strain is removed as discussed above with respect to body 208. In some embodiments both sleeve 201 and body 208 include materials that allow such flexing. This combination may create a connector in which its entire length adds to the flexibility of the connector. In other embodiments only sleeve 201 or only body 208 is flexible, and the other of sleeve 201 or body 208 is relatively rigid and inflexible.

In some embodiments where sleeve 201 is generally rigid, inner conductive member 206 can be a conductive rod may be made from any appropriate metal, such as SUP9A steel, or other conductive material. As other examples, the conductive rod can be die cast from stainless steel or stainless steel plated with copper and nickel. In other embodiments, inner conductive member 206 may be a dielectric material coated in a conductive material. In embodiments where the sleeve is generally rigid, insulation 204 can be a rigid dielectric material, such as Polyoxymethylene, or a flexible dielectric material, such as an elastomer.

In some other embodiments, inner conductive member 206 can include flexible materials that allow the sleeve to flex along its length. As an example, inner conductive member 206 can be a flexible conductive member made out of a superelastic or similar material coated with a conductive layer to carry the signal from contact 202*a*. In one embodiment, the inner conductive member can be made from nitinol, which is an alloy of nickel and titanium present in roughly equal amounts that exhibits elasticity some 10-30 times that of ordinary metal. The superelastic properties of nitinol enable it to flex under very high strain without breaking. Contacts 202*b*-202*d* can be brass or other metal contacts surrounded by a flexible elastomer (insulation 204) so that the sleeve can bend in order to relieve stress when the connector is inserted or extracted off its insertion axis 300 (as shown in FIG. 7B).

In other embodiments that include a flexible sleeve 201, inner conductive member 206 can be made from other appropriate materials, superelastic or not, that deform reversibly under very high strains and returns to its original shape when the load is removed without requiring a change of temperature to regain its original shape. As an example, inner conductive member 206 can be made from an elastomer, polyurethane or another suitable material in some embodiments. Any of these materials may be coated with a conductive layer to electrically connect to the end contact 202*a*. Alternatively, a signal wire can be run through the member 206 to provide the electrical connection.

In some embodiments, the shape or cross section of inner conductive member 206 may vary from the rod shaped previously mentioned. For example, the cross-section may be circular, polygon shaped, irregularly shaped, otherwise suitably shaped or may have varying cross-sections about its length.

Figure 7A:
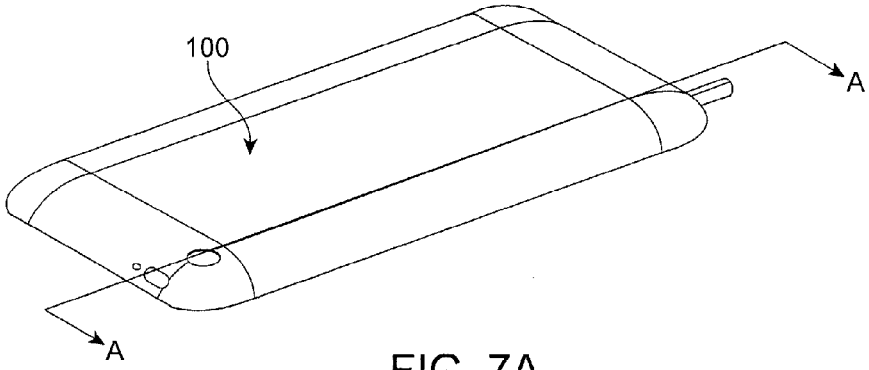
FIGS. 7A and 7B are perspective and simplified cross-sectional views of an electronic media device and a connector inserted into the electronic media device according to embodiments of the invention.
Figure 7B:
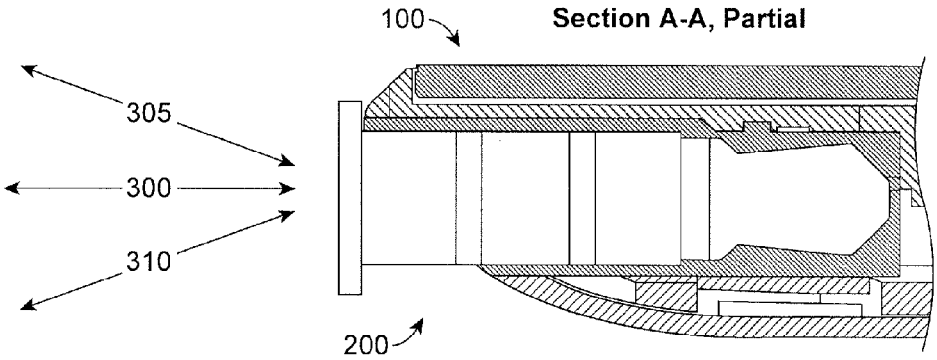

In some instances, when a plug connector according to the present invention is engaged with a corresponding receptacle connector (as shown in FIG. 7B) and extracted at an angle to the insertion axis (e.g., about force axis 305 or 310, shown in FIG. 7B), more force is applied to the base (or proximal end) of the connector than at its tip (or distal end). To address this discrepancy, some embodiments of the invention vary the flexibility of connector along its length so that, for example, connector 200 is more flexible near the base portion (or body) or proximal end of the connector and less flexible near the distal end of the connector. Flexibility can be varied in this manner by, among other techniques, varying the materials along the length of the connector, varying the thickness of flexible inner conductive member 206 and/or body 208 along its length and varying the shape of the cross-section of the flexible inner member and/or body 208 along its length or any combination of these approaches. For example, in one embodiment inner conductive member 206 may include a superelastic sheet near its base and a polyurethane sheet near its distal end. The superelastic and polyurethane sheets may overlap and be adhered together in an area between the proximal and distal ends. In one particular embodiment, member 206 comprises two sheets of polyurethane near the distal end of connector 200 and a single sheet of nitinol near the base (or proximal end) of connector 200. At a point approximately one third of the length of the connector from the distal end, the nitinol sheet is sandwiched between the two polyurethane sheets for a portion of the length. Similar designs may be applied to body 208.

In yet additional embodiments, connectors according to the present invention may have variable flexibility or rigidity about their length or about specific sections, and may also, or in the alternative, alternate between rigid and flexible throughout its length in a myriad of combinations.

In one particular embodiment, the body and the sleeve are each approximately one half the length of the connector, but the invention is not limited to any particular length or size body or sleeve or any particular ratio between the two elements. In some embodiments, the width of the contacts, insulation strips and rings, and other elements of connector 200 may be varied as compared to the relative widths illustrated in FIGS. 5A and 5B.

In one particular embodiment, connector 200 has an insertion portion of length, X1, of 14 mm; a diameter of the insertion portion, Y1, of 3.5 mm; a base portion length, X2, of 12 mm, and a diameter of the base portion, Y2, of 4.2 mm. In another particular embodiment, connector 200 has an insertion portion of length, X1, of 11 mm; a diameter of the insertion portion, Y1, of 2.5 mm; a base portion length, X2, of 11.4 mm, and a diameter of the base portion, Y2, of 3.4 mm. In other embodiments, the dimensions of connector 200 may be the same or similar to standard and miniature audio connectors, including standard TRS and TRRS audio connectors, as well as others discussion above in the "Background of the Invention" section.

The geometry of the insertion portion or sleeve of connector 200 may be selected to create a press fit plug and jack interface that requires specific insertion and extraction forces such that the retention force required to insert connector 200 into a matching connector jack (as shown in FIG. 7B) is higher than the extraction force required to remove a plug connector, such as connector 200, from the jack.

Figure 6A:
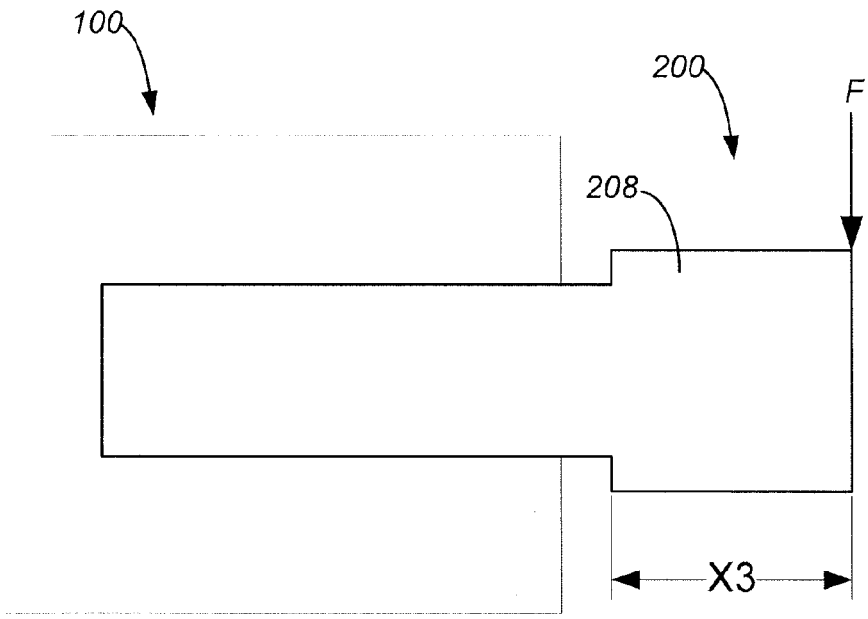
FIGS. 6A and 6B are simplified cross-sectional views of an un-deflected and deflected connector inserted within an electronic media device according to embodiments of the invention.
Figure 6B:
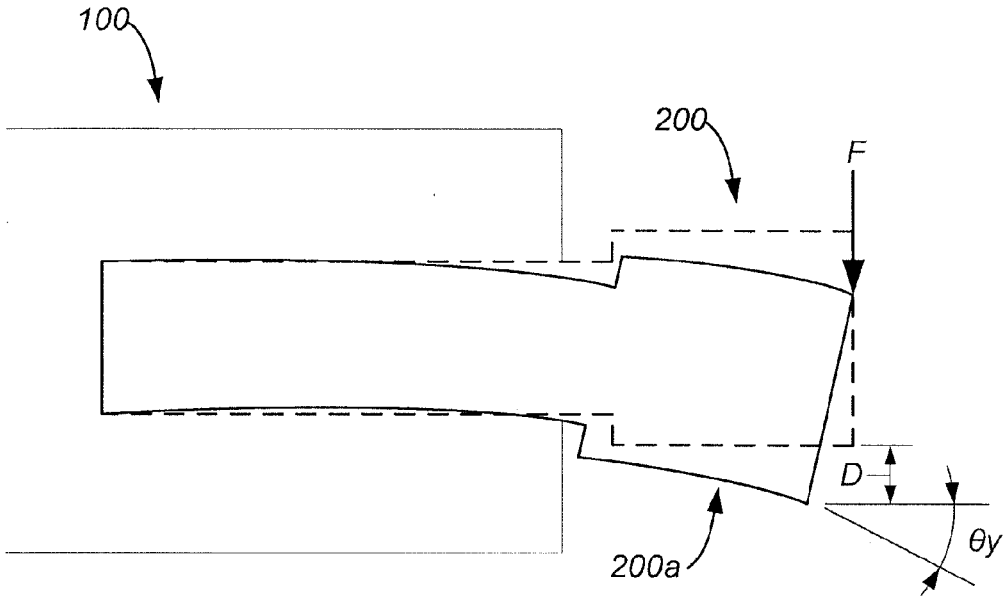

In order to better appreciate the amount of flexibility provided by certain embodiments of the invention, reference is made to FIGS. 6A and 6B. FIGS. 6A and 6B are simplified cross-sectional views that illustrate the deformation or bend that embodiments of the connector can undergo when subject to an off-axis force, e.g., when the electronic media device is dropped. As shown in FIGS. 6A and 6B, a force, F, is applied to connector 200 at a distance, X3, from the distal end of body 208 when it is inserted into electronic media device 100. Force, F, causes connector 200 to bend a distance (deflection), D, and move to bent position 200*a*. A sufficient force, F, may cause connector 200 to bend at an angle, θy, to relieve strain and prevent the connector from breaking under the force. Some embodiments of the invention allow connector 200 to bend at least 5° before reaching its yield point (where plastic deformation occurs). Other embodiments of the invention allow connector 200 to bend at least 7.5°, at least 10° or at least 20° before reaching the yield point. In embodiments where both body 208 and sleeve 201 include flexible materials as discussed above, connector 200 may have a greater capacity to provide strain relief and exhibit a greater level of flexibility than embodiments in which just one of body 208 or sleeve 201 is made with flexible materials.

In embodiments where inner conductive member 206 is a flexible conductive member, the connector may have a greater capacity to provide strain relief and exhibit a greater level of flexibility. For example, θy of these embodiments may be greater than 14° for connectors having a diameter, Y1, of 2.5 mm or greater than 13° for connectors having a diameter, Y1, of 3.5 mm before reaching the yield point. In some of these embodiments, θy may be greater than 16° for connectors having a diameter, Y1, of 2.5 mm or greater than 15° for connectors having a diameter, Y1, of 3.5 mm before reaching the yield point.

In embodiments of the present invention having variable flexibility about their length or about specific sections of the connector, the connector may exhibit the same level of flexibility as embodiments previously mentioned. In other embodiments, θy at which the connector reaches its yield point may be one or two degrees lesser or greater than embodiments previously mentioned.

The value of θy may be a product of uniform stresses throughout connector 200 or stresses may vary about the length of connector 200. For example, some portions of connector 200 may bend differently than others due to varying materials, internal structure, and additional internal components. Similarly, the force, F, may be applied to any point on the connector and may or may not be applied perpendicular to the surface of the connector.

Benefits of a flexible connector may include a reduced risk that the connector will break. FIGS. 7A and 7B are perspective and simplified cross-sectional views of an electronic media device with an inserted connector according to embodiments of the invention. FIG. 7B illustrates axis of insertion 300 and examples of possible insertion or extraction force axes, force axis 305 and force axis 310, which may be applied to connector 200 when it is inserted into or extracted from the connector receptacle of electronic media device 100. When connector 200 is extracted from electronic media device 100 with a force that intersects its insertion axis 300, e.g., forces about force axis 305 and 310, connector 200 may bend or deform; this may be referred to as an off angle mating event. The flexibility of embodiments of the present invention give the connector a greater ability to deform or deflect, and thus reduces the risk the connector will bind within or break the receptacle jack. The deformation may be limited to all or a portion of the sleeve 201, the body 208 or both the sleeve and the body of connector 200, depending on which embodiment is subjected to an off angle mating event.

In some embodiments, connectors according to the present invention are designed to break when side-loaded at a certain tension after it is inserted into a matching connector jack (as shown in FIG. 7B). It is preferable that the connector breaks as opposed to the connector jack because if the connector jack breaks, the electronic device in which it is housed may no longer be usable. To this end, in some embodiments, connectors according to the present invention may be designed to achieve this goal. As an example, when connectors according to the present invention are extracted from a matching connector jack (shown in FIG. 7B) with a force that intersects insertion axis 300 (e.g., about force axis 305 or 310), the connector may bend or deform, which reduces the risk the connector will bind within or break the connector jack (shown in FIG. 7B). In these embodiments, the flexibility of the connector is limited to the extent necessary to cause the connector to break when deflected to a point wherein the connector jack would break if the connector is deflected any further. Thus, in some embodiments, the range of acceptable deflection, D, before the breaking point of the connector is reached may be limited, e.g., the breaking point D of the connector is less than a D at which the connector will bind within or break the connector jack.

Figure 8:
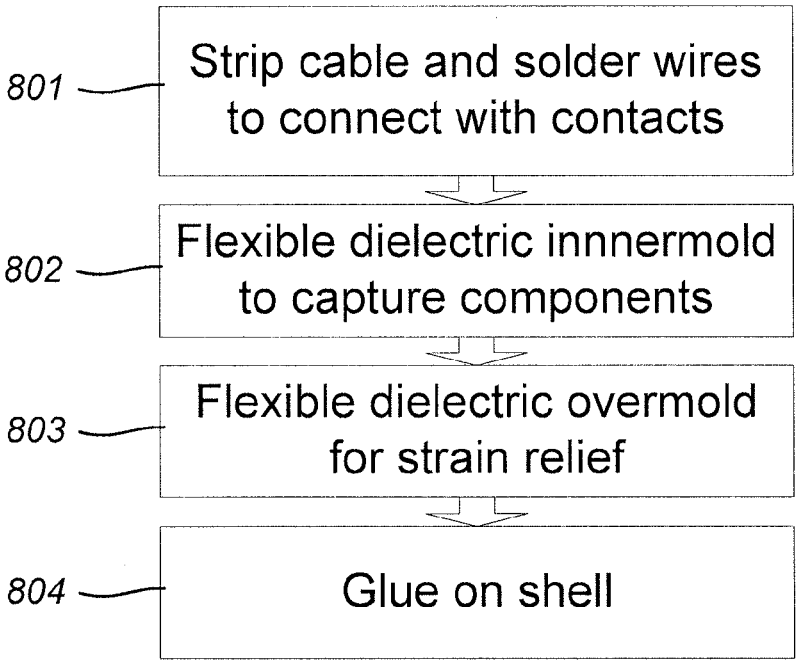
FIG. 8 illustrates a method of assembly in accordance with the present invention in which a flexible connector is assembled.

FIG. 8 illustrates a method of assembly in accordance with the invention in which connectors according to the present invention may be assembled. In step 801, a cable that is intended to run from connector 200 to a location external to connector 200 is stripped, exposing signal wires. The signal wires are soldered to contacts 202*a*-202*d* of sleeve 201 with solder connections. The connection between contact 202*a* and its respective signal wire may pass through inner conductive member 206, in which case the signal wire may be soldered to inner conductive member 206, which is already electrically connected with contact 202*a*. In step 802, a flexible dielectric, e.g., polypropylene, is injection molded to capture the exposed contacts, a protruding portion of inner conductive member 206 at the proximal end of sleeve 201, the solder connections, the signals wires protruding from the stripped cable to the contacts and member 206, and a distal portion of the un-stripped cable from which the signal wires protrude. Steps 802 produces a flexible dielectric innermold over which shell 216 may be later fitted. In step 803, a flexible dielectric, e.g., a thermoplastic elastomer, is injection molded over a portion of the cable and is flush with the end of the polypropylene innermold that is opposite to the other end that is flush with sleeve 201. Step 803 produces a flexible dielectric overmold for providing strain relief to connector 200; shell 216 may be fitted over a portion of this flexible dielectric overmold. In step 804, shell 216 is slid over sleeve 201 and affixed to complete the assembly of connector 200, held in place by a bonding agent, e.g., glue, on the inner surface of shell 216 that bonds to the outer surfaces of a portion of sleeve 201, the entire outer surface of the flexible dielectric innermold, and a portion of the outer surface of the flexible dielectric overmold. In summary, the method of assembly of embodiments of the present invention may include the following steps: strip cable and solder wires to connect with contacts (step 801), flexible dielectric innermold to capture components (step 802), flexible dielectric overmold for strain relief (step 803), and glue on shell (step 804). However, the present invention is not limited to any particular method of assembly.

Figure 1A:
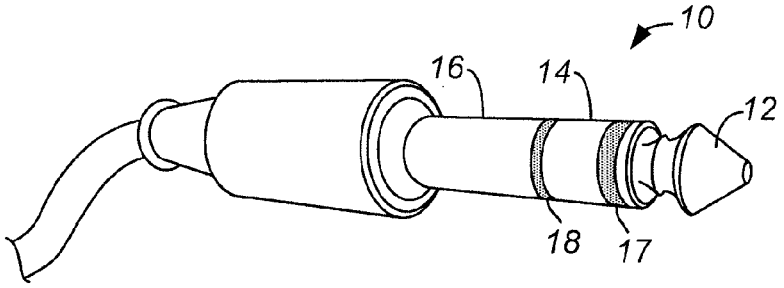
FIGS. 1A and 1B show perspective views of previously known TRS audio plug connectors.
Figure 1B:
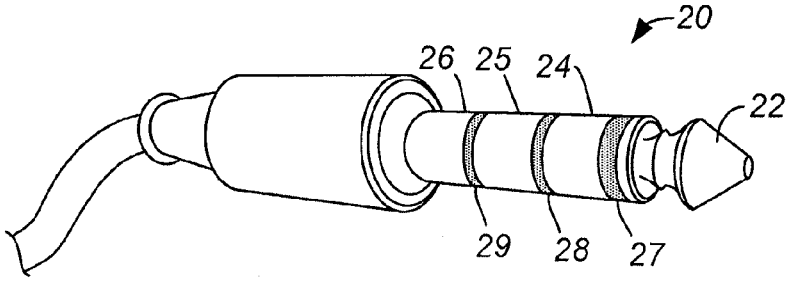
Figure 2A:
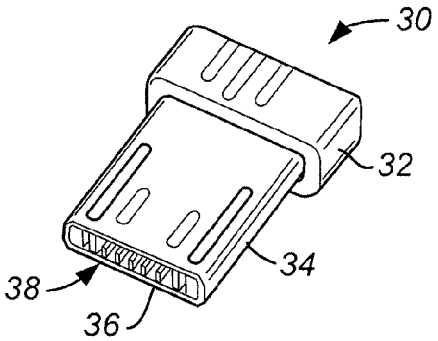
Figure 2B:
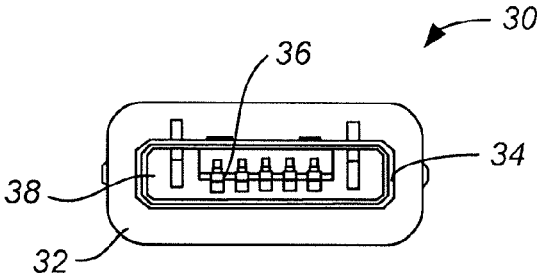
FIG. 2B shows a front plan view of the micro-USB connector shown in FIG. 2A.

As will be understood by those skilled in the art, the present invention may be embodied in other specific forms without departing from the essential characteristics thereof. For example, while embodiments of the invention were discussed above with respect to connectors and audio plugs having four contacts, the invention is not limited to any particular number of contacts. Some embodiments of the invention may have as few as two contacts while other embodiments can have thirty or even more contacts. As one example of a variation with additional contacts, additional insulation rings may be implemented so as to create additional contacts, similar to how FIG. 1B has more contacts than FIG. 1A. As another example, one embodiment of the invention includes three contacts and has a form factor that matches that of a standard, miniature or subminiature TRS connector. In other embodiments, the location of the contacts, insulation rings, and the ground contact may be interchangeable.

Additionally, while the invention was described with respect to an audio connector, it is not limited to any particular type of signal and can be used to carry video and/or other signals instead of audio-related signals or in addition to audio-related signals. Also, in some embodiments, connectors according to the present invention can carry both analog and digital signals. As an example, connectors according to the present invention can be modified to include one or more fiber optic cables that extend through the connector and can be operatively coupled to receive or transmit optical signals between a mating connector jacks. Those skilled in the art will recognize, or be able to ascertain, using no more than routine experimentation, many equivalents to the specific embodiments of the invention described herein. Such equivalents are intended to be encompassed by the following claims.

What is claimed is:

1. A plug connector comprising:

a body;

a sleeve extending longitudinally away from the body and having a circular cross section, the sleeve having an end contact at its distal tip and a plurality of ring contacts between the end contact and the body separated from each other by a dielectric material;

wherein at least a portion of the body and sleeve is made from a flexible material that allows the connector to bend along a length of the connector under strain and return to its original shape when the strain is removed.

2. The plug connector set forth in claim 1 wherein a flexibility of the connector varies along a length of the connector.

3. The plug connector set forth in claim 1 wherein the plurality of ring contacts are formed on a flex circuit.

4. The plug connector set forth in claim 1 wherein the plug connector is an audio connector.

5. The plug connector set forth in claim 1 wherein the connector is able to bend at least 5 degrees when subject to a sufficiently large off-axis force prior to causing the connector to plastically deform.

6. The plug connector set forth in claim 1 wherein the connector is able to bend at least 10 degrees when subject to a sufficiently large off-axis force prior to causing the connector to plastically deform.

7. The plug connector set forth in claim 1 wherein the connector is able to bend at least 20 degrees when subject to a sufficiently large off-axis force prior to causing the connector to plastically deform.

8. The plug connector set forth in claim 1 further comprising a flexible inner member that traverses a length of the sleeve and is electrically coupled to the end contact and wherein each of the plurality of ring contacts encircles the flexible inner member.

9. The plug connector set forth in 8 wherein the flexible inner member comprises a superelastic material coated with a conductive layer.

10. The plug connector set forth in claim 9 wherein the superelastic material comprises nitinol.

11. The plug connector set forth in claim 9 wherein the end contact comprises a ground contact.

12. The plug connector set forth in claim 11 wherein the plurality of ring contacts comprises a left audio contact and a right audio contact.

13. The plug connector set forth in claim 12 wherein the plurality of ring contacts further comprises a microphone contact.

14. The plug connector set forth in claim 13 wherein the body comprises an elastomer material formed over a proximal end of the sleeve.

15. The plug connector set forth in claim 1 wherein the body comprises an elastomer material formed over a proximal end of the sleeve.

16. The plug connector set forth in claim 15 wherein the elastomer material is a thermoplastic elastomer.

17. The plug connector set forth in claim 15 wherein the end contact comprises a ground contact.

18. The plug connector set forth in claim 17 wherein the sleeve has an outer diameter of about 3.5 mm and an insertion depth of about 14 mm.

19. The plug connector set forth in claim 17 wherein the sleeve has an outer diameter of about 2.5 mm and an insertion depth of about 11.4 mm.

20. The plug connector set forth in claim 17 wherein the plurality of ring contacts comprised a left audio contact and a right audio contact.

21. The plug connector set forth in claim 20 wherein the plurality of ring contacts further comprises a microphone contact.

* * * * *

UNITED STATES PATENT AND TRADEMARK OFFICE

CERTIFICATE OF CORRECTION

PATENT NO. : 9,124,048 B2
APPLICATION NO. : 13/703000
DATED : September 1, 2015
INVENTOR(S) : Albert J. Golko et al.

It is certified that error appears in the above-identified patent and that said Letters Patent is hereby corrected as shown below:

In the claims:

Column 12, Line 48, Claim 20; please delete “comprised” and insert --comprises--.

Signed and Sealed this
Twenty-ninth Day of December, 2015

Michelle K. Lee

Michelle K. Lee
*Director of the United States Patent and Trademark Office*